US006310526B1

(12) United States Patent
Yip et al.

(10) Patent No.: US 6,310,526 B1
(45) Date of Patent: Oct. 30, 2001

(54) DOUBLE-THROW MINIATURE ELECTROMAGNETIC MICROWAVE (MEM) SWITCHES

(76) Inventors: Lap-Sum Yip, 57 Granville Blvd., Hampstead Quebec (CA), H3X 3B7; Cindy Xing Qiu, 6215 Bienville St., Brossard Quebec (CA), J4Z 1W6; Yi-Chi Shih, 2216 Thorley Pl., Palos Verdes Estate, CA (US) 90274

( * ) Notice: Subject to any disclaimer, the term of this patent is extended or adjusted under 35 U.S.C. 154(b) by 0 days.

(21) Appl. No.: 09/400,256

(22) Filed: Sep. 21, 1999

(51) Int. Cl.[7] ..... H01H 57/00
(52) U.S. Cl. ..... 333/262; 200/181
(58) Field of Search ..... 333/262; 200/181; 216/2; 455/78; 361/233

(56) References Cited

U.S. PATENT DOCUMENTS

| | | | | |
|---|---|---|---|---|
| 5,578,976 | * | 11/1996 | Yao | 333/262 |
| 5,880,921 | * | 3/1999 | Tham | 361/233 |
| 6,016,092 | * | 1/2000 | Qui | 333/262 |
| 6,049,702 | * | 4/2000 | Tham | 455/78 |
| 6,160,230 | * | 12/2000 | McMillian | 200/181 |

* cited by examiner

*Primary Examiner*—Justin P. Bettendorf
*Assistant Examiner*—Dean Takaoka

(57) ABSTRACT

Miniature double-throw microwave switches are disclosed in this invention. In one embodiment a miniature double-throw electromagnetic switch for microstrip transmission lines is provided. A cantilever, which forms a part of an input transmission line, with a permanent magnetic film can be pulled down or pushed up by an applied magnetic field to make electrical contact with either one of two output transmission lines. The applied magnetic field is generated by applying a positive or negative current to a miniature electromagnetic coil mounted under the cantilevers. In another embodiment, a miniature double-throw microwave switch with two cantilevers attached to the input transmission line is disclosed for microstrip transmission lines. The magnetic polarizations of the permanent magnetic films on the two cantilevers are controlled in such a way that when a magnetic field is applied, one cantilever will be pulled downward to make electrical contact to a first output transmission line. When a reverse magnetic field is applied, the second cantilever will be pulled downward to make electrical contact to a second output transmission line. Yet another embodiment of this invention is a multilayer thin film electromagnetic coil where the magnetic fields induced in all layers of the coils aligned in the same direction to form a strong magnetic field with reduced power consumption.

21 Claims, 5 Drawing Sheets

DOUBLE-THROW MINIATURE ELECTROMAGNETIC MICROWAVE (MEM) SWITCHES

BACKGROUND OF THE INVENTION

1. Field of the Invention

The invention relates generally to miniature electromagnetic switches for microwave systems. More specifically, the invention relates to a miniature double-throw electromagnetic microwave switch capable of operation in three different states.

2. Description of the Prior Art

Switches are a basic building block of communication electronics and can find many applications in telecommunications. They are widely used for telecommunications applications such as signal routing, redundancy switching, impedance matching networks and adjustable gain amplifiers. Mechanical relay, PIN diode and FET are the common microwave switches. Mechanical relays offer the benefits of low insertion loss, large off-state isolation, and high power handling capabilities. However, they consume a lot of power and are bulky, heavy and slow. Semiconductor switches such as PIN diode and FET provide much faster switching speed and smaller size and weight but are inferior in insertion loss, isolation and power handling capabilities than mechanical relays.

Microwave switches providing the advantageous properties of both the mechanical relay and semiconductor switch are then highly desirable, especially for space, airborne and mobile telecommunications applications. Micromachining technologies promise to enable the fabrication of such switches, i.e., switches with the high microwave performance of mechanical switches but also with the small size, weight and power consumption of semiconductor switches. Furthermore, conventional microelectronics fabrication processes are usually used for micromachining, making the integration of such miniature switches with other active electronics possible.

In U.S. patent application Ser. No. 09/131,594 entitled 'Miniature Electromagnetic Microwave Switches and Switch Arrays' filed on Aug. 10, 1998 by the same inventors, now U.S. Pat. No. 6,016,092 single-throw micro electromagnetic switches in a coplanar waveguide, microstrip or stripline form were described. A double-throw switch in a stripline form was also described. In this invention, miniature double-throw electromagnetic switches on dielectric substrates in a microstrip form and with controlled magnetization are disclosed. These double-throw switches are useful in many applications for effective switching and routing of microwave signals.

SUMMARY OF THE INVENTION

The present invention provides multilayer thin film electromagnetic coil, miniature double-throw switches and switch arrays for microwave communications.

In one embodiment of this invention, a multilayer thin film electromagnetic coil where the magnetic fields induced in all layers of the coils aligned in the same direction is disclosed. This multilayer thin film electromagnetic coil may be fabricated by IC technology. Using the multilayer thin film electromagnetic coil, strong magnetic field can be induced with reduced power consumption.

In another embodiment, double-throw miniature electromagnetic microwave switches for microstrip transmission lines are disclosed. The switches are created on a dielectric substrate by a micromachining process or an evaporation process. According to this invention, this structure consists of a dielectric substrate, an input transmission line having a first cantilever, a first output transmission line, a second output transmission line having a second cantilever, and a miniature electromagnetic coil. A layer of permanent magnetic material is deposited on a portion of the first cantilever. The first cantilever is in its normal position when no current is applied to the miniature electromagnetic coil. When a positive current is applied to the miniature coil, an electromagnetic force is generated to attract the first cantilever to a down position, so that it is in contact with the first output transmission line. When a negative current is applied to the miniature electromagnetic coil, a reversed electromagnetic force is generated to push the first cantilever to an up position so that it is in contact with the second cantilever and, therefore, the second output transmission line.

In yet another embodiment, a double-throw switch is disclosed which consists of a dielectric substrate, an input transmission line having a first cantilever with a first permanent magnetic film and a second cantilever with a second permanent magnetic film, a first output transmission line, and a second output transmission. The magnetic polarizations of the first magnetic film and the second magnetic film are arranged in such a way that when a miniature electromagnetic coil is activated, the forces applied to the first cantilever will be opposite to that to the second cantilever under the same electromagnetic field induced by the miniature electromagnetic coil. Therefore, the input transmission line will make contact to either one of the two output transmission lines, depending on the current direction applied to the coil.

The single-pole, single-throw miniature electromagnetic microwave switches described in U.S. patent application Ser. No. 09/131,594, entitled 'Miniature Electromagnetic Microwave Switches and Switch Arrays' filed on Aug. 10, 1998 by the inventors of this application, have many advantages such as high performances, small requirements of resources (size, weight and power consumption) and possible integration with other integrated electronics. In many applications, however, double-throw or multiple-throw switches are required for efficient switching or routing of microwave signals. The present invention allows the fabrication of miniature electromagnetic double-throw or multiple-throw switches based on the micromachining technologies. Multiple cantilevers in a double-throw switch can be controlled by a single electromagnetic coil to reduce size, complexity and power consumption of the switch. For a multiple-throw switch, more than one electromagnetic coil may be needed to control all the cantilevers. It should be noted that only double-throw switches are described in the present invention; however, multiplethrow and/or multiple-pole switches can be easily built based on the present invention with only small modification to the switch structure.

DETAILED DESCRIPTION OF THE PREFERRED EMBODIMENTS

For microwave applications, the switches used may base on resistive coupling or capacitive coupling. To simplify the description, miniature electromagnetic switches based on a resistive coupling will be used in the following description. It is understood that switches based on capacitive coupling may as well be constructed and fabricated using the structures to be described in this invention. To create an electromagnetically actuated microwave switch, it is required to have a compact electromagnetic coil. According to one embodiment of this invention, a multilayer thin film electromagnetic coil suitable for the actuation of micro electromagnetic switches is provided.

Figure 1A:
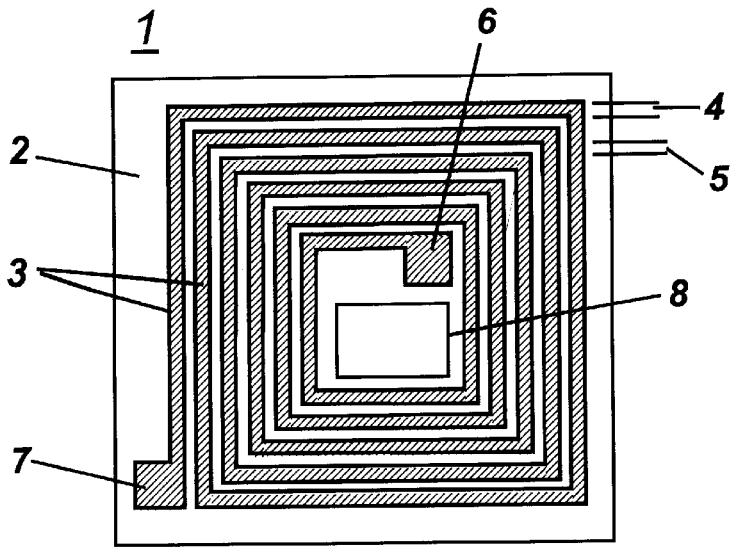
FIG. 1 (*a*) A schematic top view of a miniature thin film electromagnetic coil, (b) schematic cross-sectional views of an odd coil and an even coil and (c) a schematic cross-sectional view of a multilayer thin film electromagnetic coil containing three odd coils and three even coils.
Figure 1B:
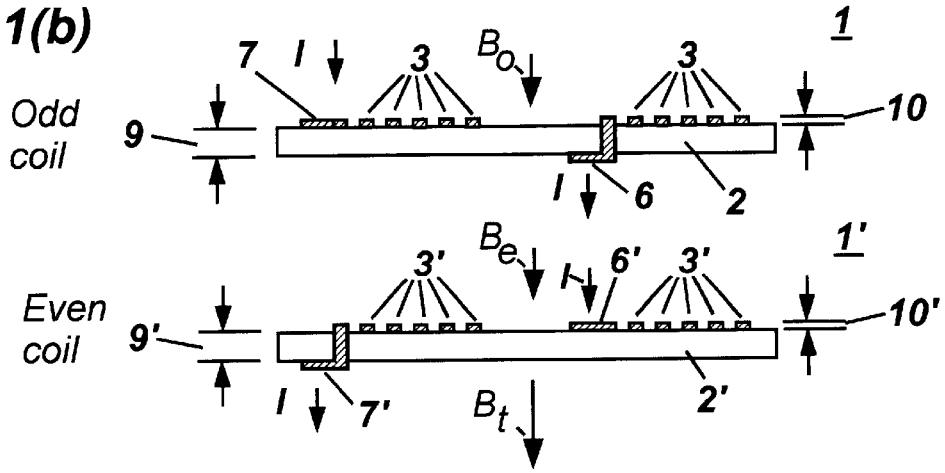
Figure 1C:
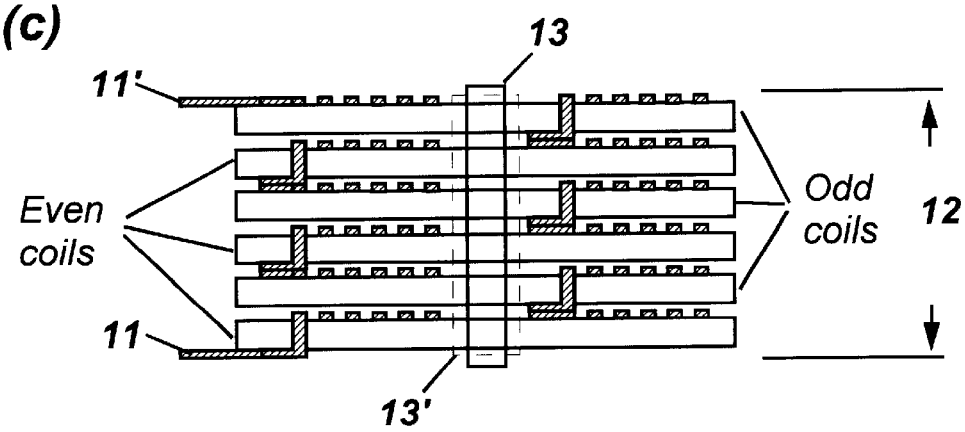

In FIG. 1(*a*), a schematic top-view of a single thin film electromagnetic coil (1) is shown. A single thin film electromagnetic coil, hereinafter called single coil, similar to the one shown in FIG. 1(*a*) has been described in U.S. patent application Ser. No. 09/131,594 entitled 'Miniature Electromagnetic Microwave Switches and Switch Arrays'. According to the present invention, the single coil is fabricated on and supported by an insulating membrane (2) such as polyimide or other plastic materials. Thin film metal strips (3) forming a spiral coil are created by depositing and patterning a metallic layer such as Al or Cu. Although single layer metal may be sufficient, it is often preferred to use multilayer structure in order to improve adhesion to the insulating membrane. Width (4) of each strip is from 5 to 100 $\mu$m, dependent upon processing technology and the current to pass through. Gap (5) between adjacent strips is in the order of 20 $\mu$m in order to avoid shorting between adjacent strips. A first contact pad (6) is provided at the end of the innermost strip and a second contact pad (7) is provided at the end of the outermost strip. Although the coil given in the above example consists of linear segments, substantially circular spirals may be advantageously used as the electromagnetic coils in order to improve uniformity of magnetic field distribution.

A central coil region (8) is provided in order to provide space for the addition of a magnetic core (13 in FIG. 1(*c*)) when necessary. The induced magnetic field can be enhanced if a core with high permeability is used. With this core added, the magnetic field near the central coil region may be enhanced significantly.

It is well know that the magnetic field created by an electromagnetic coil in general and by a thin film electromagnetic coil in particular is proportional to the product of number of turns, N, and current, I, flowing through it. In order to reduce power consumption due to joule heating in the electromagnetic coil, it is preferable to reduce the value of current for the actuation while maintaining the strength of the induced magnetic field. This can be achieved by increasing the number of turns, N. Since N is limited for given dimensions of the electromagnetic coil, due to restrictions on the line width and spacing for the thin film fabrication processes, the magnetic field induced is also limited. According to the first embodiment of this invention, a multiple layer electromagnetic coil with enhanced efficiency, i.e. with reduced power consumption and increased magnetic field, is constructed by incorporating several thin film electromagnetic coils as shown in FIG. 1(*c*). In order to simplify the description, a multiple layer electromagnetic coil containing six single coils is used as an example.

In order to use the single coils to form a multilayer coil, the first contact pad (6, 6') must be located on one side of the insulating membrane (2, 2') whereas the second contact pad (7, 7') located on the other side of the insulating membrane (see Odd coil and Even coil shown in FIG. 1(*b*)). This is one of the differences between the present single thin film coil and a conventional spiral coil. Furthermore, in order to form a multilayer coil by stacking several single coils while maintaining electrical continuity, the arrangement of contact pads on adjacent single coils must be different. As shown in FIG. 1(*b*), for an Even coil which is to be fabricated to the bottom side of an Odd coil, the first contact pad (6') must be located on the top surface in order to get in contact with the first contact pad (6) located on the bottom of the Odd coil. Similarly, the second contact pad (7') on the Even coil must be located on the bottom side of the insulating membrane so that electrical contact can be made to the second contact pad (7) on the top side of a second Odd coil, which is to be added to the bottom surface of the Even coil. In FIG. 1(*b*), Even coil is formed by thin film metal strip (3'). When the Odd coil (1) is connected electrically to the even coil (1'), a current (I) may be applied to induce a magnetic field. The arrangement of the Odd coil is clockwise when viewing from top and moving from the second contact pad (7) toward the first contact pad (6). Since the current (I) is flowing from the second contact pad (7) along the coil to the first contact pad (6), this current creates a magnetic field $B_o$, which is pointing downward, in Odd coil (1).

The same current (I) will flow from the first contact (6) of the Odd coil to the first contact pad (6') of the Even coil to induce another magnetic field ($B_e$). For the Even coil, the arrangement is counter clockwise when viewing from the top and going from the second contact pad (7') toward the first contact pad (6'). Hence, when the current (I) is flowing from the first contact pad (6') toward the second contact pad (7'), the induced magnetic field ($B_e$) is pointing downward, the same direction as that for ($B_o$). Hence, both ($B_o$) and ($B_e$) will add together to give a total induced external magnetic field ($B_t$). When several Even coils and Odd coils are stacked together alternately to form a multilayer electromagnetic coil, the total induced external magnetic field at a constant current is proportional to the number of coils adopted. The insulating membrane may be applied by spin coating a layer of polyimide so that the thickness (9, 9') is in the order of 20 μm. The actual rotation speed and time are determined by the viscosity of the polyimide used. After the spin coating of the polyimide, it must be baked to reduce the amount of solvent. Thickness (10,10') of the conducting strips may be in the range of 2 to 10 μm. This can be achieved by vacuum deposition, electrodeposition and screen printing.

A multilayer electromagnetic coil may be formed by stacking several Odd coils and equal number of Even coils in an alternate manner (see FIG. 1(*c*)). This is achieved by stacking a first Even coil underneath a first Odd coil, stacking a second Odd coil under the first Even coil, etc. Electrical contacts between adjacent single coils must be established. This may be achieved by depositing solder materials (not shown) on the first contact pad and the second contact pad for each single coil. After alignment, the multilayer coil may be heated to melt the solder material. Since the Odd coils and Even coils are formed by thin film processes, the total thickness (12, see FIG. 1(*c*)) of the final multilayer electromagnetic coil which is equal to the number of single coils times the thickness of a single coil (which is equal to the summation of thickness (9) and twice of thickness (10)) may be as small as 200 μm. A top electrical contact (11') and a bottom contact (11) may now be formed for the application of driving current. The multilayer electromagnetic coil may also be formed by thin film deposition and photolithographic methods. For instance, after the deposition and fabrication of the first Odd coil, a layer of polyimide may be spun-coated. The polyimide may then be baked and selectively etched to expose contact to the first contact pad in the Odd coil. A layer of metal is then deposited and patterned using a photomask containing coil pattern for an Even coil. After this, a new layer of polyimide is spun-coated, baked and selectively etched to reveal the contact window for the second contact pad of the Even coil. A new layer of metal is now deposited and selectively etched. The complete multilayer coil may be fabricated by repeating the above processes using the thin film deposition and photolithographic methods.

Figure 2:
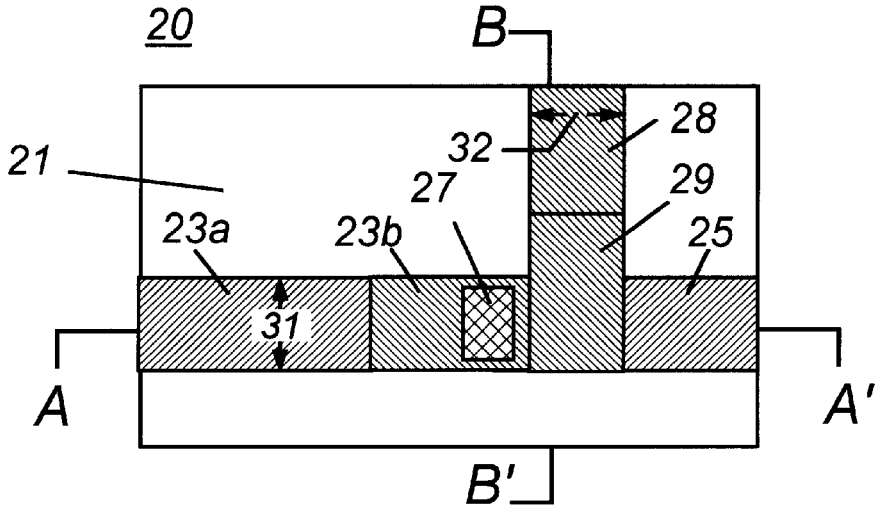
FIG. 2 A schematic top view of a miniature double-throw microwave switch (20) fabricated on a dielectric substrate (21).
Figure 3:
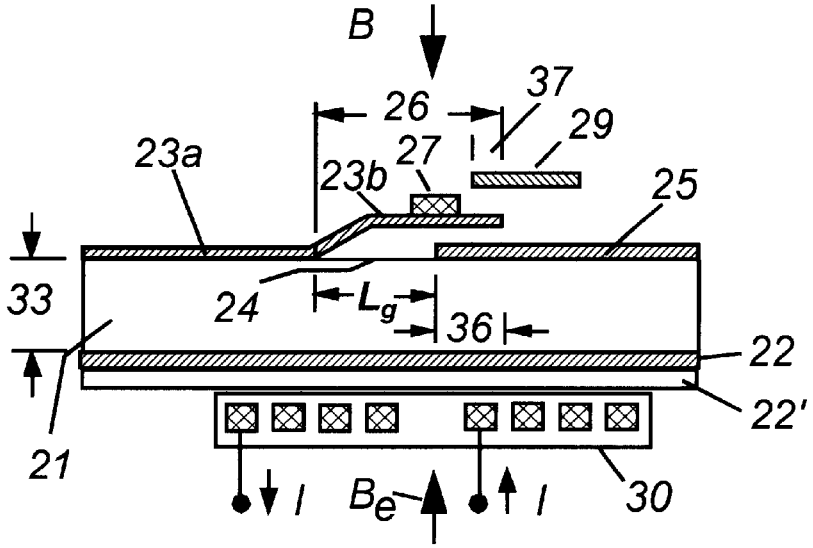
FIG. 3 A schematic cross-sectional view of the double-throw microwave switch (20) taken along the line A—A' in FIG. 2.
Figure 4:
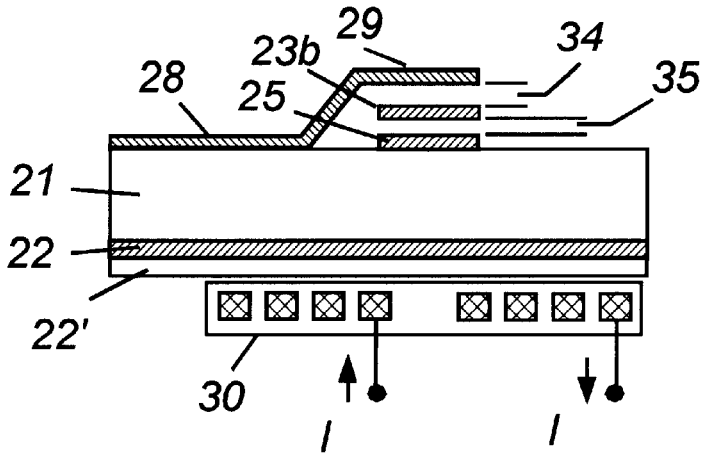
FIG. 4 A schematic cross-sectional view of the double-throw microwave switch (20) taken along the line B—B' in FIG. 2.

Three schematic views of a miniature double-throw electromagnetic switch (20), hereinafter called switch, for microstrip transmission lines according to the second embodiment of this invention are shown in FIGS. 2, 3 and 4. FIG. 2 shows a schematic top view of the double-throw electromagnetic switch. FIG. 3 and FIG. 4 show respectively the schematic cross-sectional views of the switch taken along line A—A' and B—B' as shown in FIG. 2. As shown in top view of FIG. 2, the switch is fabricated on a dielectric substrate (21) with a ground plane (22 in FIGS. 3 and 4) deposited on back side of the dielectric substrate. Thickness of the ground plane is in a range from 0.5 μm to 10 μm, dependent on the skin depth of the microwave signals to transmit. An input microstrip line (23*a*) and a first output microstrip line (25) are deposited on a front side of the dielectric substrate. It is seen that the input microstrip line (23*a*) and the first output microstrip line (25), which are separated by a gap having a length, $L_g$ (24), are aligned in such a way that a continuous microstrip line can be formed when they are connected electrically. A first cantilever (23*b*) with a length L (26) is deposited over the gap with one end of the cantilever connecting to the input microstrip line (23*a*) and another end suspending over the first output microstrip line (25) (see FIG. 3). The first cantilever may be a metal membrane, a dielectric membrane with a conductive coating on a front surface, or a dielectric membrane with a conductive coating on a back surface. A layer of permanent magnetic material (27) is deposited on part of the first cantilever (23*b*). A second output microstrip line (28) having a second cantilever (29) is deposited so that the second cantilever is suspended over the first cantilever. The second cantilever may be a metal membrane, a dielectric membrane with a conductive coating on a front surface, or a dielectric membrane with a conductive coating on a back surface. It is noted that in FIG. 2, 3 and 4 the second output microstrip line (28) with the second cantilever (29) is shown to be deposited on the same dielectric substrate (21) with the input microstrip line and the first output microstrip line. However, the second output microstrip line can also be fabricated, without the second cantilever (29), on a second dielectric substrate, which should be placed on top of the first substrate with proper alignment. The second cantilever (29) overlaps part of the first cantilever (23*b*) in region without the magnetic film so that when the first cantilever is pushed upwards, leading portion of the first cantilever (23*b*) can make electrical contact with the second cantilever (29). A layer of dielectric material (22') such as $SiO_2$ or polyimide is applied on the ground plane (22). A miniature electromagnetic coil (30) is then deposited or attached to the dielectric material. The miniature electromagnetic coil may be a multilayer coil disclosed in the first embodiment of this invention. Widths (31) of the input microstrip line (23*a*) and the first output microstrip line are selected to be substantially equal to the width (32) of the second output microstrip line. Values of (3 1) and (32) are determined by the thickness (33, in FIG. 3) of the dielectric substrate (21), the dielectric constant, and the central frequency of the microwave signals to transmit for low loss operation. The second output microstrip line (28) may be arranged so that it makes an angle of roughly 90 degrees with respect to the input microstrip line (23*a*). As shown in FIG. 4, gap (34) between the first cantilever (23*b*) and the second cantilever (29) is selected substantially to be equal to gap (35) between the first cantilever (23*b*) and the first output microstrip line (25). Values of the gap (34) and gap (35) are preferably in a range from 2 to 100 μm in order to minimize coupling of microwave signals between two non-contacting electrodes. Thickness of the microstrip lines is in a range from 0.5 μm to 10 μm, dependent on the skin depth of the microwave signals to transmit.

The operation of the double-throw miniature electromagnetic switch (20) is as follows. When no current is applied to the miniature electromagnetic coil (I=0), no magnetic force is applied to the first cantilever (23*b*) and it is in a normal position between the first output microstrip line (25) and the second cantilever (29). When a positive current (I>0) is applied to the miniature electromagnetic coil, so that the direction of the magnetic field ($B_e$) induced is substantially parallel and opposite to the magnetic polarization ($B_m$) of the magnetic film, an attraction force will be caused on the first cantilever (23*b*). When the current (I) exceeds a pull-down threshold or when the force is sufficiently large, the first cantilever (23*b*) will be deformed so that the cantilever, attaching to the input microstrip line (23*a*), will get in contact with the first output microstrip line (25). Microwave signals supplying to the input microstrip line (23*a*) will be allowed to reach the first output microstrip line (25). Since there is no electrical contact between the first cantilever (23*b*) and the second cantilever (29), which is connected to the second output microstrip line (28), the incoming microwave signals will not reach the second output microstrip line. When the current (I) through the miniature electromagnetic coil is reversed, so that the direction of the magnetic field ($B_e$) induced is substantially parallel and along the magnetic polarization ($B_m$) of the magnetic film, a repulsion force will be caused on the first cantilever. When the reverse current (I) exceeds a push-up threshold or the repulsion force is sufficiently large, the first cantilever (23*b*) will be pushed away from the first output microstrip line (25) and eventually get in contact with the second cantilever (29) connected to the second output microstrip line (28). Microwave signals supplying to the input microstrip line (23*a*) will not be allowed to reach the first output microstrip line (25). Since there is an electrical contact between the first cantilever (23*b*) and the second cantilever (29), the incoming microwave signals will reach the second output microstrip line (28).

In order to ensure reliable switching of microwave signals, the relative position of first cantilever (23*b*), the second cantilever (29) and the first output microstrip line (25) must be maintained. FIG. 3 shows a cross-sectional view of (20), with the miniature electromagnetic coil, taken along the line A–A' as shown in FIG. 2. The overlap between the first output microstrip line (25) and the first cantilever (23*b*) is (36) whereas the overlap between the first cantilever (23*b*) and the second cantilever (29) is (37). The widths of the two overlapping regions are designed to be at least 10 $\mu$m so that reliable switching of microwave signals can be achieved. However, the widths of the overlapping regions should not be too large in order to minimize the capacitances between the electrodes. It should be noted that several double-throw miniature electromagnetic switches may be combined into a single switching array for switching and routing of microwave signals. It is further noted that the double-throw switch can be switched off, i.e. with the first cantilever (23*b*) without contact with the first output microstrip line (25) and the second cantilever (29), by switching off the current (I=0) or by applying a short pulse of reverse current. By applying a short pulse of reverse current to turn off the switch, any sticking of the cantilever to the output electrode can be avoided, which is often encountered in miniature switches based on electrostatic actuation.

The permanent magnetic film (27) may be deposited by vacuum deposition or preferably, by an electrodeposition method. This is because the magnetization of the deposited films can be relatively easily induced by applying an external magnetic field during the electrodeposition.

The miniature electromagnetic coil (30) may be deposited directly on the dielectric layer (22') attached to the back side of the dielectric substrate (21). This miniature electromagnetic coil may be the multilayer coil disclosed in the first embodiment of this invention. To simplify the fabrication steps, the miniature electromagnetic coil may also be deposited on a second dielectric substrate, which is different from the dielectric substrate (21). This second substrate may be a glass slide or polyimide sheet. After the fabrication of the miniature electromagnetic coil, it is aligned and attached to the back side of the substrate.

In some microwave applications, it may be required to have micro-switches that can give rise to different signal delays, e.g. a phase shifter. A plurality of phase shifter with different amount of phase shifts may be combined to form a complete programmable phase shifter unit. Conventional method to form a switch unit for delaying microwave signals usually requires at least two double-throw switches which are actuated by two different electromagnetic coils. As an example of this invention, a miniature electromagnetic switch structure containing at least two cantilevers that are actuated by only one miniature electromagnetic coil is described.

Figure 5:
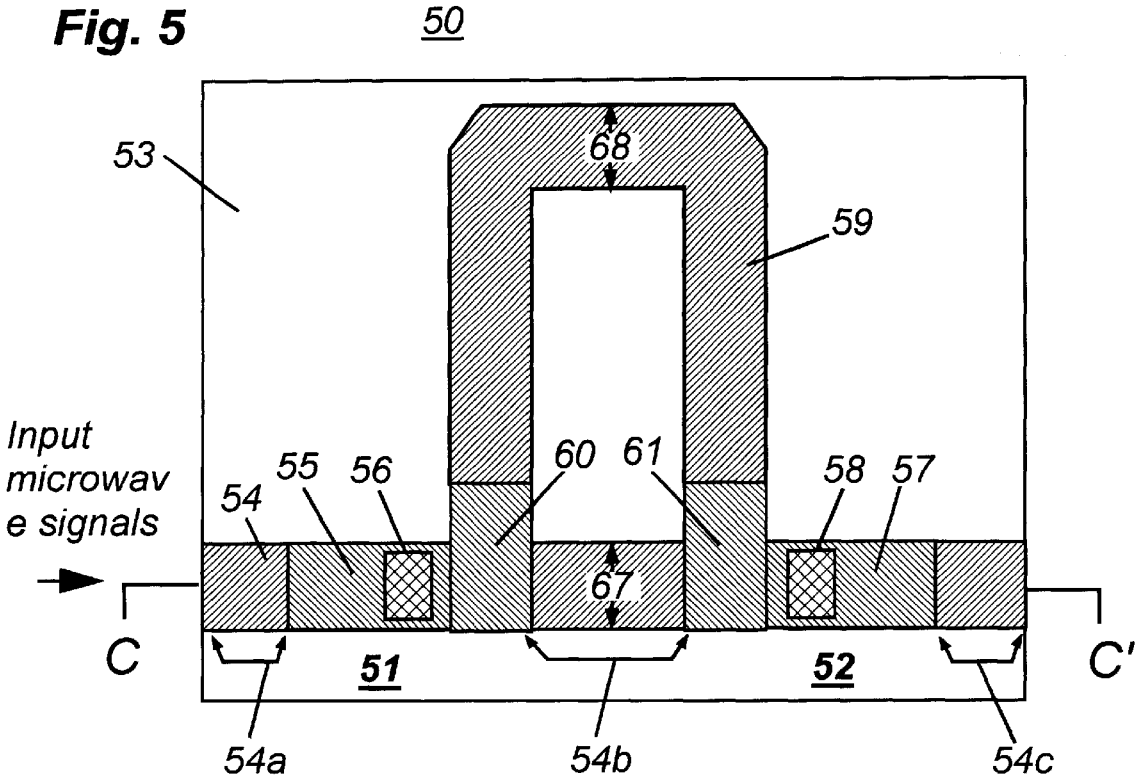
FIG. 5 A schematic top view of a microwave phase shifter (50) containing two transmission line sections and a first double-throw switch with a first permanent magnetic film and a second double-throw switch with a second permanent magnetic film. Magnetic polarization of the first magnetic film is the same as that of the second magnetic film.
Figure 6:
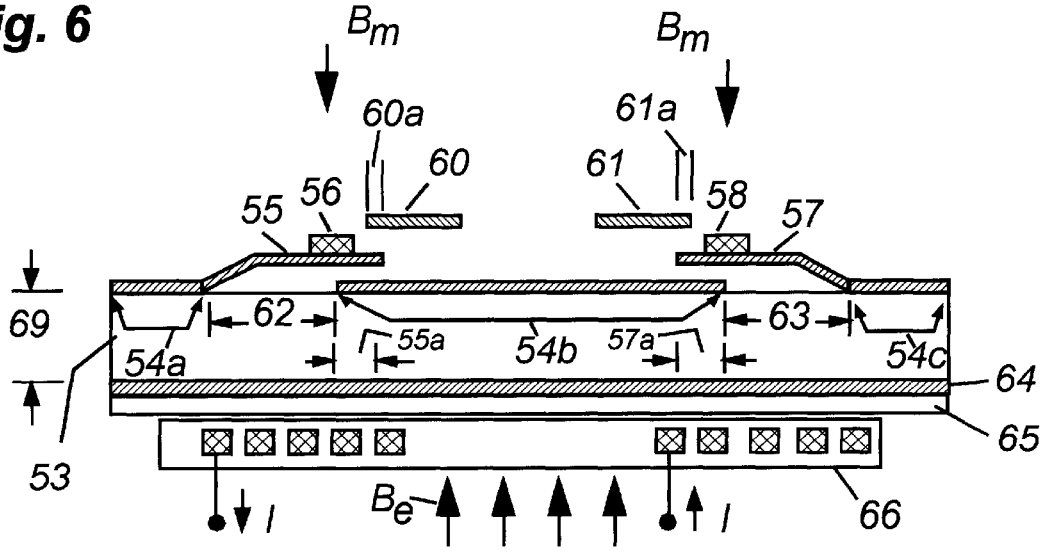
FIG. 6 A schematic cross-sectional view of the microwave phase shifter (50) taken along the line C—C' in FIG. 5.

FIG. 5 shows a top view of a switch structure (50) containing two double-throw miniature electromagnetic switches (51,52) deposited on a dielectric substrate (53) whereas FIG. 6 is a schematic cross-sectional view taken along the line C–C' as shown in FIG. 5. This structure represents a phase delay unit, or phase shifter unit, for microwave signals. The first microstrip line (54) consists of three portions (54*a*, 54*b* and 54*c*). Portion (54*a*) is aligned to portion (54*b*) and portion (54*c*). Portion (54*a*) and portion (54*b*) are separated by a distance (62) whereas portion (54*b*) and portion (54*c*) are separated by another distance (63). A first cantilever (55) is attached to right end of portion (54*a*) with a first permanent magnetic film (56) deposited and overlapping part of (54*b*). In FIG. 6, the overlap region between the first cantilever (55) and portion (54*b*) is indicated as (55*a*). A second cantilever (57) is attached to left end of portion (54*c*) with a second permanent magnetic film (58) deposited and overlapping part of (54*b*). The first cantilever and the second cantilever may be a metal membrane, a dielectric membrane with a conductive coating on a front surface, or a dielectric membrane with a conductive coating on a back surface. The overlap region between the second cantilever (57) and portion (54*b*) is indicated as (57*a*). A second microstrip line (59) with a U-shape is deposited with a third cantilever (60) overlapping part of (55), forming the first double-throw switch (51), and with a fourth cantilever (61) overlapping part of (57), forming a second double-throw switch (52). The third cantilever and the fourth cantilever may be metal membranes, dielectric membranes with a conductive coating on a front surface, or dielectric membranes with a conductive coating on a back surface. The total length of the second microstrip line (59) is selected in order to give a specific delay or phase shift of microwave signals with respect to the first microstrip line (54). Hence, when microwave signals are switched from the first microstrip line (54) to the second microstrip line (59), a specific amount of delay or phase shift may be introduced. A miniature electromagnetic coil (66) is deposited on or attached to a dielectric material (65), which is deposited on the ground plane (64). This miniature electromagnetic coil may be the multilayer coil disclosed in the first embodiment of this invention. Furthermore, an enhancing magnetic core (13) may be inserted in a cavity (13') as shown in FIG. 1(*c*) to enhance the magnetic induction. This enhancement will reduce the magnitudes of the pull-down threshold current and the push-up threshold current. Width (67) of the first microstrip line (54) is made to be substantially equal to the width (68) of the second microstrip line (59). Values of (67) and (68) are determined by the thickness (69, in FIG. 6) of the dielectric substrate (53), the dielectric constant, and the central frequency of the microwave signals to transmit for low loss operation.

Since only one miniature electromagnetic coil (66) is used to actuate the two cantilevers (55,57), the directions of magnetic polarization ($B_m$) on the two magnetic films (56, 58) must be the same. When a positive current (I) is applied to the miniature electromagnetic coil (66), the magnetic field ($B_e$) created will be in a direction substantially opposite to that for the two magnetic films and will induce attraction forces on both cantilevers, causing contact with second portion (54*b*) of the first microstrip line. Hence microwave signals incident from portion (54*a*) will be allowed to go through portion (54*b*) to reach portion (54*c*). Since there is no electrical contact with the second microstrip line (59), microwave signals will not be coupled from portion (54*a*) to the second microstrip line. When the current applied to the miniature electromagnetic coil is reversed, the magnetic field from the miniature electromagnetic coil will be inverted to induce repulsion forces on both cantilevers, causing contact with a third cantilever (60) and a fourth cantilever (61) connected to the second microstrip line (59). The overlap region between the third cantilever (60) and the first cantilever (55) is indicated as (60*a*) whereas the overlap region is (61*a*) between the fourth cantilever (61) and the second cantilever (57). Hence microwave signals incident from portion (54*a*) will be allowed to go through (59) to reach portion (54*c*) to introduce a specific phase shift or delay. Since there is no electrical contact with the portion (54*b*), microwave signals will not be coupled from portion (54*a*) to portion (54*b*).

Figure 7A:
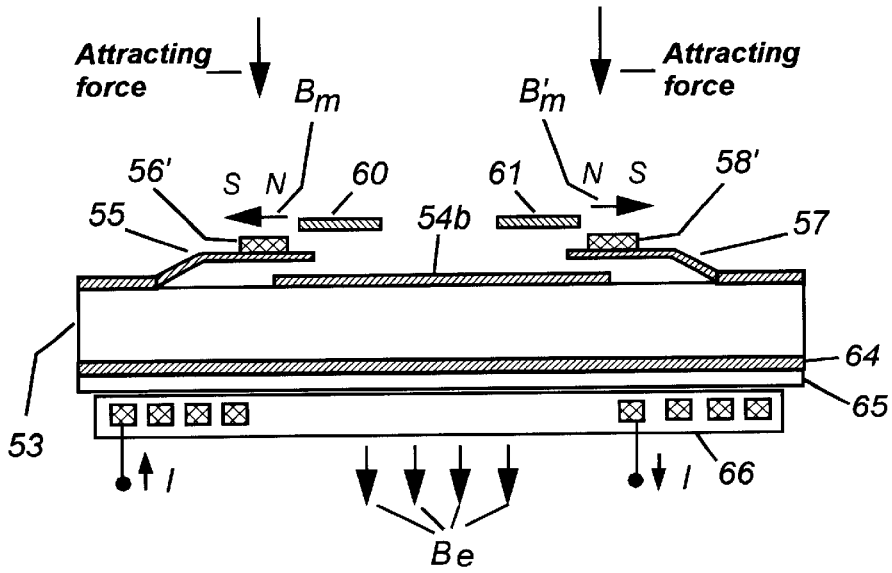
FIG. 7 (*a*) A schematic cross-sectional view of a microwave phase shifter, similar to (50) shown in FIG. 6, containing a first double-throw switch with a first permanent magnetic film and a second double-throw switch with a second permanent magnetic film, showing the actuating forces when a current is applied. The magnetic polarizations of the two magnetic films are opposite to each other and substantially parallel to the substrate. (b) Actuating forces inverted when the current is inverted.
Figure 7B:
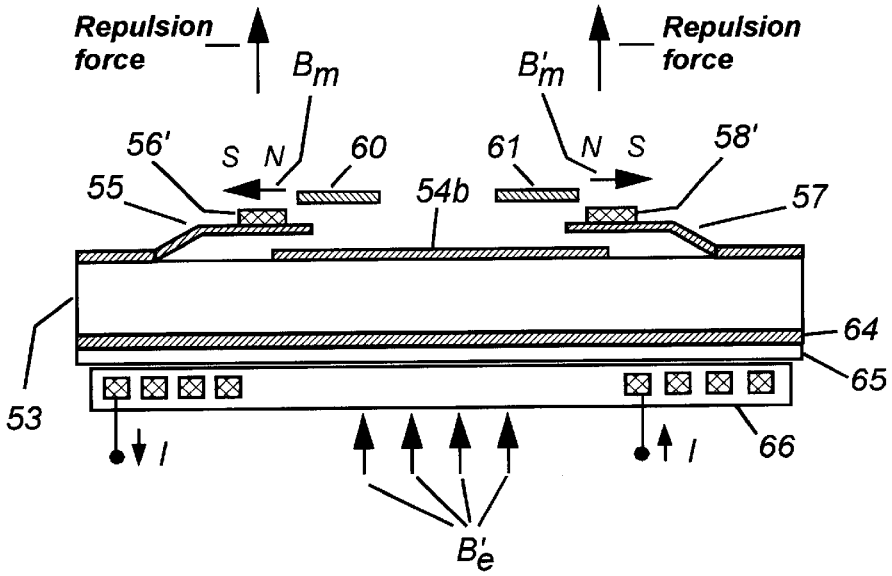

Although the magnetic polarizations of the permanent magnetic films shown in FIGS. 2, 3, 5 and 6 are perpendicular to the substrate (21, 53), miniature electromagnetic microwave switches with permanent magnetic films where the magnetic polarizations are substantially parallel to the surface of the substrates may be constructed. FIG. 7(*a*) and FIG. 7(*b*) show an example of such a switch that is similar to the one shown in FIG. 6 except the magnetic polarization of the permanent magnetic films (56', 58') is parallel to the substrate (53). It is noted that the magnetic polarization ($B_m$, which is represented by an arrow pointing from N to S) of the first permanent magnetic film (56') is opposite to the magnetic polarization ($B'_m$, which is represented by an arrow pointing from N to S) of the second permanent magnetic film (58'). The different magnetic polarization can be achieved by a separate magnetization method, which will be described in a later part of the description. When a current (I) is applied to the miniature electromagnetic coil, a magnetic field ($B_e$) is induced and an attracting force will be induced on the first cantilever to bend this cantilever downward so that the first cantilever is in contact with portion (54*b*). Similarly, the magnetic field ($B_e$) induced will induce another attracting force on the second cantilever to bend it downward so that the second cantilever is in contact with portion (54*b*). Conversely, when the direction of the induced magnetic field is reversed (see FIG. 7(*b*)), repulsion forces will be induced to push the two cantilevers upward. As shown in FIG. 7(*b*), when the current is reversed an opposite magnetic field ($B_e'$) is induced and a repulsion force will be induced on the first cantilever to bend this cantilever upward so that the first cantilever is in contact with the third cantilever (60). Another repulsion force will be induced on the second cantilever to bend it upward so that the second cantilever is in contact with the fourth cantilever (61).

Figure 8:
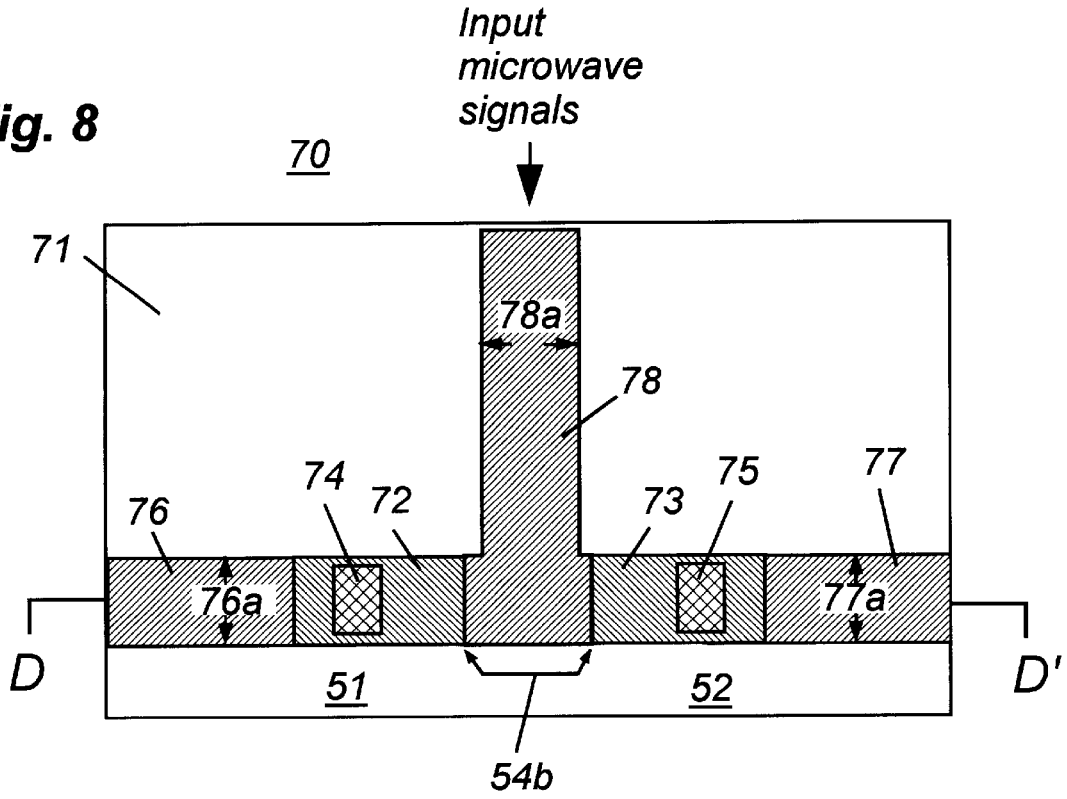
FIG. 8 A schematic top view of a miniature double-throw microwave switch (70) containing a first cantilever with a first permanent magnetic film and a second cantilever with a second permanent magnetic film. Magnetic polarization of the first magnetic film is different from that of the second magnetic film.

Using IC fabrication technology, according to another embodiment of this invention, a miniature double-throw electromagnetic switch structure that is different from the double-throw switch described above for signal switching may be constructed. FIG. 8 shows a top view of miniature electromagnetic switch (70) on a dielectric substrate (71) containing a first cantilever (72) and a second cantilever (73) forming a double-throw switch. The first cantilever and the second cantilever may be metal membranes, dielectric membranes with a conductive coating on a front surface, or dielectric membranes with a conductive coating on a back surface. A first permanent magnetic film (74) is deposited on the first cantilever (72) whereas a second permanent magnetic film (75) is deposited on the second cantilever (73). The first cantilever (72) overlaps part of a first output microstrip line (76) whereas the second cantilever (73) overlaps part of a second output microstrip line (77). Both cantilevers (72, 73) are connected to the input transmission line (78). Hence one end of the input transmission line (78) has a first cantilever and the other end has a second cantilever.

Figure 9:
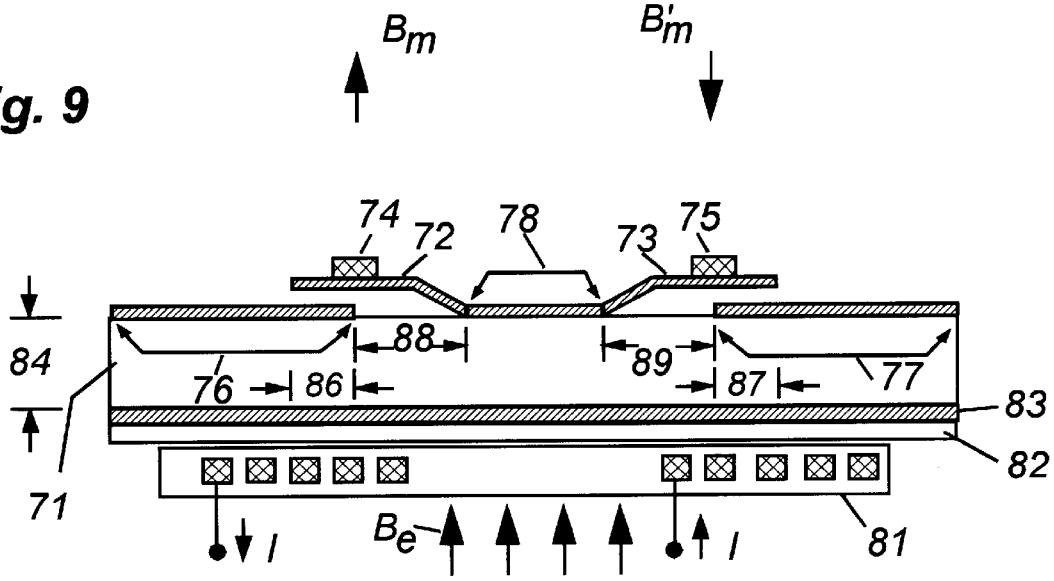
FIG. 9 A schematic cross-sectional view of the microwave switch (70) taken along the line D—D' in FIG. 8.

As seen in FIG. 9, a miniature electromagnetic coil (81) is deposited or in contact with a dielectric material (82), which is deposited on the ground plane (83). Width (76*a*) of the first output microstrip line (76) is made to be substantially equal to the width (77*a*) of the second output microstrip line (77). Width (78*a*) of the input microstrip line is designed to be the same as the width (76*a*) of the first output microstrip line (76). Values of widths (76*a*), (77*a*) and (78*a*) for low loss operation are determined by the thickness (84, in FIG. 9) of the dielectric substrate (71), the dielectric constant, and the central frequency of the microwave signals to transmit. As seen in FIG. 9, the first output microstrip line (76) and the input microstrip line (78) are separated by gap (88) whereas the second output microstrip line (77) is separated from the input microstrip line (78) by another gap (89). Values of the gaps (88) and (89) are kept to at least 100 $\mu$m in order to minimize coupling between adjacent microstrip lines. Thickness of the first output microstrip line, the second output microstrip line and the input microstrip line are in a range from 0.5 $\mu$m to 10 $\mu$m, dependent on the skin depth of the microwave signals to transmit.

Since only one miniature electromagnetic coil (81) is used to actuate the two cantilevers (72,73), the magnetic polarizations ($B_m$, $B_m'$) on the two magnetic films (74, 75) must be different. When the magnetic polarizations are different, preferably opposite, and with a positive current (I) applied to the miniature electromagnetic coil (81), the magnetic field ($B_e$) created will induce attraction force on the second cantilever (73) and a repulsion force on the first cantilever (72), causing contact of the second cantilever (73) with the second output microstrip line (77) while causing an open between the first cantilever (72) and the first output microstrip line (76). The applied current should be greater than a first pull-down threshold current to ensure a proper electrical contact between the second cantilever (73) and the second output microstrip line (77). Hence microwave signals incident from the input microstrip line (78) will be allowed to go through the second cantilever (73) to reach the second output microstrip line (77). Since there is no electrical contact with the first microstrip line (76), microwave signals will not be coupled from the input microstrip line (78) to the first output microstrip line (76). When the current applied to the miniature electromagnetic coil is reversed, the magnetic field from the miniature electromagnetic coil will be inverted to induce a repulsion force on the second cantilever (73) and an attraction force on the first cantilever (72), causing contact between the first cantilever (72) and the first output microstrip line (76) while causing an open between the second cantilever (73) and the second output microstrip line (77). The applied reverse current should be greater than a second pull-down threshold current to ensure a proper electrical contact between the first cantilever (72) and the first output microstrip line (76). Hence, when the current I is inverted, microwave signals incident from the input microstrip line (78) will be allowed to go through the first cantilever (72) to reach the first output microstrip line (76). Since there is no electrical contact between the second cantilever (73) and the second output microstrip line (77), microwave signals will not be coupled from the input microstrip line (78) to the second output microstrip line (77).

In order to ensure reliable switching of microwave signals, the relative position between the first cantilever (72) and the first output microstrip line (76) and the relative position between the second cantilever (73) and the second output microstrip line (77), must be maintained. FIG. 9 shows a cross-sectional view of taken along the line D–D' in FIG. 8. The overlap between the first cantilever (72) and the first output microstrip line (76) is (86) whereas the overlap between the second cantilever (73) and the second output microstrip line (77) is (87). The widths of the two overlapping regions are designed to be at least 10 $\mu$m so that reliable switching of microwave signals can be achieved. It is noted that the widths of the overlapping regions should not be too large in order to minimize the capacitances between the microstrip lines.

The miniature electromagnetic coil (81) may be deposited directly on the dielectric layer (82) applied on the back side of the dielectric substrate (71) with the ground plate (83). To simplify the fabrication steps, the miniature electromagnetic coil may be deposit on a substrate that is different from (71). This substrate may be a glass slide or polyimide sheet. After the fabrication of the miniature electromagnetic coil, it is aligned and attached to the back side of the substrate.

According to this invention, the magnetic polarization ($B_m$and $B'_m$) of the two permanent magnetic films are arranged to be different and preferably opposite during the fabrication of the switch structure. This is achieved by depositing the first magnetic film (74) but not the second magnetic film (75). During the deposition of the first magnetic film, a first external magnetic field obtained from an external permanent magnet or an external electromagnetic coil such as (81) is applied. The purpose of the external field is to allow the formation of the first permanent magnetic film with the magnetic polarization ($B_m$) aligned to the first external magnetic field. Since the strength of the first external magnetic field required to magnetize a permanent film during deposition is quite small, the current required to apply during the deposition may be very small. After the deposition of the first permanent magnetic film (74), it is protected while the region for the second permanent magnetic film is exposed. The second magnetic film (75) is then deposited. During the deposition of the second magnetic film, a second external magnetic field obtained from the external permanent magnet or the external electromagnetic coil is reversed. The purpose of the second external magnetic field is to allow the formation of the second permanent magnetic film (75) with the magnetic polarization ($B'_m$) aligned to the second external magnetic field and preferably opposite to the magnetic polarization of the first permanent magnet film, which is aligned to the first external magnetic field.

It has been known that during the formation of a hard magnetic material, the magnetization may be affected by the application of weak external magnetic field. The strength of the external magnetic field required for this purpose ranges from a fraction of a gauss to tens of a gauss. Preferably, the applied external magnetic field should be substantially greater than the geomagnetic field so that unequivocal control of the magnetization of the deposited permanent magnetic film can be achieved. Since the external magnetic field strength applied during the deposition of a magnetic film to cause a strong magnetization is much smaller than the magnetic field strength capable of altering the magnetic polarization after the deposition, the magnetic polarization of the first permanent magnetic film will not be affected by the external magnetic field applied during the deposition of the second permanent film. Hence, after the deposition of the two permanent magnetic films, their magnetic polarizations will be different or even opposite. Although the magnetic polarizations of the permanent magnetic films shown in FIG. 8 and 9 are perpendicular to the substrate (71), miniature electromagnetic microwave switches with permanent magnetic films where the magnetic polarization is substantially parallel to the surface of the substrates may be constructed, similar to FIG. 7.

It is further noted that the double-throw miniature switch can be switched off, i.e. with the first and second cantilever (72, 73) in a normal position, by switching off the current (I=0) or by applying a short pulse of reverse current. The switching off by the application of a short pulse of a reverse current can avoid sticking of the cantilever to the microstrip lines, which is often encountered in miniature switches based on electrostatic actuation.

The foregoing description is illustrative of the principles of the present invention. The preferred embodiments may be varied in many ways while maintaining the spirit of this invention. For instance, several miniature double-throw electromagnetic switches as described above may be combined into a single switching array for switching of routing of microwave signals. Furthermore, double-throw switches and switch arrays may be fabricated in a form of coplanar waveguide (CPW), striplines or other structures. Therefore, all modifications and extensions are considered to be within the scope and spirit of the present invention.

The embodiments of the invention in which an exclusive property privilege is claimed are defined as follows:

1. A miniature double-throw electromagnetic microwave switch comprising;

a first dielectric substrate having at least one input transmission line, a first output transmission line and a second output transmission line deposited on a front surface of said first dielectric substrate for propagating and routing of microwave signals;

a first cantilever connected to said input transmission line and with projection overlapping at least a part of said first output transmission line;

a second cantilever connected to said second output transmission line and with projection overlapping at least a part of said first cantilever;

a permanent magnetic film deposited on a part of a top surface of said first cantilever for actuating said first cantilever;

a conducting ground layer deposited on a back surface of said dielectric substrate;

a dielectric film coated on part of said conducting ground layer; and a thin film electromagnetic coil on said dielectric film for actuating said first cantilever, center of said thin film electromagnetic coil substantially coincides with center of said magnetic film.

2. A miniature double-throw electromagnetic microwave switch as defined in claim 1, further comprising means to supply electric current to said thin film electromagnetic coil, magnitude of said electric current is greater than a pull-down threshold current, to actuate said first cantilever, causing electric connection between said input transmission line and first output transmission line.

3. A miniature double-throw electromagnetic microwave switch as defined in claim 1, further comprising means to supply a reverse electric current to said thin film electromagnetic coil, magnitude of said reverse electric current is greater than a push-up threshold current, to actuate said first cantilever, causing electric connection between said input transmission line and second output transmission line.

4. A miniature double-throw electromagnetic microwave switch as defined in claim 1, wherein said first cantilever and second cantilever are selected from a group of a metal membrane, and a dielectric membrane with conducting coatings on both a front surface and a back surface.

5. A miniature double-throw electromagnetic microwave switch as defined in claim 1, wherein said input transmission line and output transmission lines are patterned conducting thin films with thickness between 0.5 μm and 10 μm.

6. A miniature double-throw electromagnetic microwave switch as defined in claim 1, wherein said permanent magnetic film is prepared by a method selected from a group of electrodeposition and vacuum deposition.

7. A miniature double-throw electromagnetic microwave switch as defined in claim 1, wherein said first cantilever is released by switching off said electric current being supplied to said thin film electromagnetic coil.

8. A miniature double-throw electromagnetic microwave switch as defined in claim 1, wherein said first cantilever is released by supplying an opposing electric current to said thin film electromagnetic coil, magnitude of said opposing current being substantially smaller than magnitudes of said push-up threshold current and pull-down threshold current.

9. A miniature double-throw electromagnetic microwave switch as defined in claim 1, further comprising an enhancing magnetic core inserted into a cavity formed in a central region of said thin film electromagnetic coil to decrease magnitudes of said pull-down threshold current and push-up threshold current.

10. A miniature double-throw electromagnetic microwave switch as defined in claim 1, wherein said second output transmission line is deposited on a second dielectric substrate, said second output transmission line is aligned over said first cantilever to receive microwave signals from said first cantilever.

11. A miniature double-throw electromagnetic microwave switch as defined in claim 1, further comprising a step of adding a second dielectric substrate on top of said switch to form a miniature switch for microwave striplines, said second dielectric substrate having a conducting coating on a front surface.

12. A miniature double-throw electromagnetic microwave switch comprising;

a first dielectric substrate having at least one input transmission line, a first output transmission line, a second output transmission line for propagating and routing of microwave signals;

a first cantilever having a first permanent magnetic film and connected to a first end of said input transmission line and with projection overlapping at least a part of a first output transmission line, magnetic polarization of said first permanent magnetic film being aligned to a first direction;

a second cantilever having a second permanent magnetic film and connected to a second end of said input transmission line and with projection overlapping at least a part of a second output transmission line, magnetization of said second permanent magnetic film being aligned to a second direction;

a conducting ground layer deposited on back surface of said first dielectric substrate;

a dielectric film coated on part of said conducting ground layer; and a first thin film electromagnetic coil disposed on said dielectric film for actuating said cantilevers, center region of said thin film electromagnetic coil substantially overlaps with centers of said magnetic films.

13. A miniature double-throw electromagnetic microwave switch as defined in claim 12, further comprising means to supply a first electric current to said thin film electromagnetic coil, magnitude of said first electric current is greater than a first pull-down threshold current, to actuate said first cantilever and attract said first cantilever to get in contact with said first output transmission line, to actuate said second cantilever and repel said second cantilever to disconnect contact with said second output transmission line.

14. A miniature double-throw electromagnetic microwave switch as defined in claim 12, further comprising means to supply a second electric current to said thin film electromagnetic coil, magnitude of said second electric current is greater than a second pull-down threshold current, to actuate said second cantilever and attract said second cantilever to get in contact with said second output transmission line, to actuate said first cantilever and repel said first cantilever to disconnect contact with said first output transmission line.

15. A miniature double-throw electromagnetic microwave switch as defined in claim 12, wherein said first cantilever and second cantilever are selected from a group of a metal membrane, a dielectric membrane with a conducting coating on a front surface and a dielectric membrane with a conducting coating on a back surface.

16. A miniature double-throw electromagnetic microwave switch as defined in claim 12, wherein said input transmission line, first output transmission line and second output transmission line are patterned conducting thin films with thickness between 0.5 μm and 10 μm.

17. A miniature double-throw electromagnetic microwave switch as defined in claim 12, wherein method of preparing said permanent magnetic film is selected from a group of electrodeposition and vacuum deposition.

18. A miniature double-throw electromagnetic microwave switch as defined in claim 12, wherein said first and second cantilevers are released by switching off said electric current being supplied to said thin film electromagnetic coil.

19. A miniature double-throw electromagnetic microwave switch as defined in claim 12, wherein said first and second cantilevers are released by supplying an opposing electric current to said thin film electromagnetic coil, magnitude of said opposing current being substantially smaller than magnitudes of said first pull-down threshold current and second pull-down threshold current.

20. A miniature double-throw electromagnetic microwave switch as defined in claim 12, further comprising an enhancing magnetic core inserted into a cavity formed in a central region of said thin film electromagnetic coil to decrease magnitudes of said pull-down threshold current and push-up threshold current.

21. A miniature double-throw electromagnetic microwave switch as defined in claim 12, further comprising a step of adding a second dielectric substrate on top of said switch to form a miniature switch for microwave striplines, said second dielectric substrate having a conducting coating on a front surface.

* * * * *